US005923260A

United States Patent [19]

Endo et al.

[11] Patent Number: 5,923,260

[45] Date of Patent: Jul. 13, 1999

[54] SMOKE DETECTING APPARATUS UTILIZING LIGHT SIGNAL PULSE WIDTHS

[75] Inventors: Ichiro Endo; Yukio Yamauchi, both of Tokyo, Japan

[73] Assignee: Hochiki Corporation, Tokyo, Japan

[21] Appl. No.: 09/107,129

[22] Filed: Jun. 30, 1998

[30] Foreign Application Priority Data

Jun. 30, 1997 [JP] Japan ..... 9-173968

[51] Int. Cl.[6] ..... G08B 17/10

[52] U.S. Cl. ..... 340/630; 340/628; 250/574

[58] Field of Search ..... 340/630, 628, 340/629, 512; 250/574

[56] References Cited

U.S. PATENT DOCUMENTS

| | | | |
|---|---|---|---|
| 4,618,853 | 10/1986 | Yuchi | 340/505 |
| 5,319,575 | 6/1994 | Lilienfeld | 702/26 |
| 5,477,218 | 12/1995 | Manmoto et al. | 340/630 |
| 5,576,697 | 11/1996 | Nagashima et al. | 340/630 |

FOREIGN PATENT DOCUMENTS

| | | |
|---|---|---|
| 2 017 994 | 10/1979 | United Kingdom . |
| 2 044 504 | 10/1980 | United Kingdom . |
| 2 274 333 | 7/1994 | United Kingdom . |

*Primary Examiner*—Jeffery A. Hofsass
*Assistant Examiner*—Sihong Huang
*Attorney, Agent, or Firm*—Sughrue, Mion, Zinn, Macpeak & Seas, PLLC

[57] ABSTRACT

The pulse width of a light reception pulse signal a from a light receiving device is detected, and the smoke density is detected based on a total pulse width of pulse widths per unit time period. Alternatively, the smoke density may be detected based on an integrated value of the light reception pulse signal a from the light receiving device per unit time period. Even if the flow rate of the sucked air is varied, the total light reception pulse width value per unit time period is not varied, so that the smoke density can be accurately detected.

9 Claims, 6 Drawing Sheets

T
a1
a2
a3
a4
TH
t
Tw1
Tw2
Tw3
Tw4
b1
b2
b3
b4

T
a1
a2
a3
a4
SL
t b1
b2
b3
b4
t t t

SMOKE DETECTING APPARATUS UTILIZING LIGHT SIGNAL PULSE WIDTHS

BACKGROUND OF THE INVENTION

1. Field of the Invention

The present invention relates to a smoke detecting apparatus which determines a fire by optically detecting smoke particles suspended in air sucked from a monitored zone, by means of laser light.

2. Description of the Related Art

Conventionally, a supersensitive smoke detecting apparatus is used for detecting a fire at an extremely early stage in a clean space which is represented by a computer room or a clean room for semiconductor manufacturing equipment.

In such a supersensitive smoke detecting apparatus, air is sucked through a pipe disposed in the clean space. Smoke particles contained in the sucked air are passed through a smoke detecting area which is irradiated with laser light from a laser diode. In the light reception pulse signal due to light scattered by the smoke particles and detected by a light receiving device, pulses having a level which exceeds a predetermined threshold value are counted for a unit time period. Based on the count number per unit time period, even a very low smoke density in the range of, for example, 0.05 to 0.20%/m is detected.

In such a supersensitive smoke detecting apparatus which detects the smoke density by counting pulses of the light reception pulse signal, however, the count number of scattered light per unit time period is varied by fluctuations of the flow rate of the sucked air. This results in a problem in that the smoker density cannot be accurately detected.

In order to solve the problem, in the conventional apparatus, the flow rate of the sucked air is measured by a flowmeter, a correction coefficient is obtained from a preset flow rate and the detected flow rate, and a count number per unit time period is corrected. Specifically, when the actual detected flow rate Q is higher than the preset flow rate Qr, the count number per unit time period is increased, and thus the smoke density is detected to be rather higher. Therefore, a correction coefficient K is obtained by an expression of $K=Qr/Q$. The count value per unit time period is multiplied by the correction coefficient, to be corrected to the count value converted for the preset flow rate. Accordingly, the smoke density can be correctly detected.

However, the correction of the count number per unit time period to the variation in the flow rate of the sucked air necessitates a flowmeter, and the production cost of the apparatus is remarkably increased. In addition, when any failure occurs in the flowmeter, there arises another problem in that the smoke density cannot be accurately detected.

SUMMARY OF THE INVENTION

It is an object of the invention to provide a supersensitive smoke detecting apparatus which does not require the measurement of the flow rate of sucked air and which can accurately detect the smoke density based on a count of scattered light even if the flow rate of the sucked air is varied.

According to the present invention, a smoke detecting apparatus which determines a fire by optically detecting smoke particles suspended in air sucked from a monitored zone, comprises: a light projecting section which projects laser light emitted from a laser diode to a smoke detecting area through which the sucked air passes; a light receiving section in which light scattered by smoke particles passing through the smoke detecting area is received by a light receiving device, and which outputs a light reception pulse signal; and a smoke density detecting section which detects a smoke density based on the light reception pulse signal from the light receiving section.

In the smoke detecing apparatus, the smoke density detecting section which detects a pulse width of the light reception pulse signal supplied from the light receiving section, and detects the smoke density based on a total pulse width of the pulse width per unit time period. Alternatively, the smoke density detecting section detects the smoke density based on an integrated value of the light reception pulse signal supplied from the light receiving section, every a unit time period.

According to the invention, a total value of pulse widths per unit time period or an integrated value per unit time period is obtained for the light reception pulse signal for scattered light obtained as a result of passage of smoke particles, and a smoke density is detected based on the obtained value. Even if the flow rate of the sucked air is varied, therefore, the total pulse-width value or the integrated value per unit time period is not varied. Thus, it is possible to detect a very low smoke density with higher accuracy by receiving scattered light due to the passing smoke particles, without being affected by fluctuations of the flow rate of the sucked air.

In addition, because there is no influence by fluctuations of the flow rate, it is unnecessary to dispose a flowmeter for detecting the flow rate of the sucked air unlike the apparatus of the prior art. Consequently, the apparatus can be made simple in structure so as to be compactly produced, and can be realized at a low production cost.

DETAILED DESCRIPTION OF THE INVENTION

Figure 1:
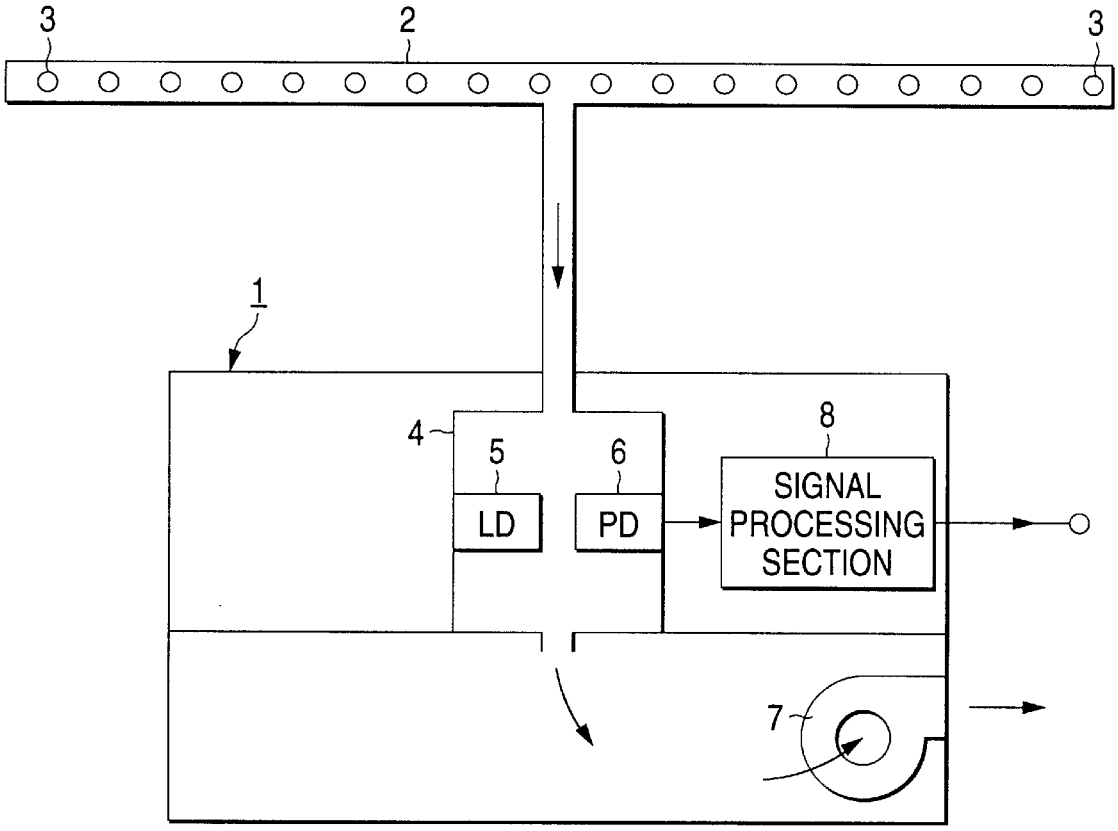
FIG. 1 is a diagram illustrating the whole configuration of the smoke detecting apparatus according to the invention.

Detailed description of the present invention will be described as follows.

The present invention is configured in the following manner. First, the invention is a smoke detecting apparatus which determines a fire by optically detecting smoke particles suspended in air sucked from a monitored zone, and which comprises: a light projecting section which projects laser light emitted from a laser diode to a smoke detecting area through which the sucked air passes; and a light receiving section in which light scattered by smoke particles passing through the smoke detecting area is received by a light receiving device, and which outputs a light reception pulse signal.

In addition, the invention is characterized in that a smoke density detecting section is disposed which detects a pulse width of the light reception pulse signal supplied from the light receiving section, and detects a smoke density based on a total pulse width of the pulse width per unit time period.

According to the invention, the smoke density is detected from a total value of pulse widths of the light reception pulse signals per unit time period instead of the count number of scattered light. Even if the flow rate of the sucked air is varied, the total value of light reception pulse widths per unit time period is not varied, and hence the smoke density can be accurately detected.

When the actual flow rate is increased with respect to a preset flow rate serving as a reference, the velocity of smoke particles passing through the smoke detecting space is increased, and also the pulse number of the light reception pulse signal for scattered light per unit time period is increased. However, the pass time required for the smoke particles to pass through the smoke detecting area is shortened, and also the time period in which scattered light can be received is shortened, so that the pulse width of the light reception pulse signal is decreased. As a result, even if the pulse number of the light reception pulse signal is increased, the pulse width is decreased in correspondence with the increase. By offsetting the decrease and the increase, therefore, the total value of light reception pulse widths per unit time period is made unvaried.

In contrast, when the actual flow rate is reduced with respect to the preset flow rate serving as a reference, the velocity of smoke particles passing through the smoke detecting space is decreased, and also the pulse number of the light reception pulse signal for scattered light per unit time period is decreased. However, the pass time required for the smoke particles to pass through the smoke detecting area is increased, and hence also the time period in which scattered light can be received is increased, so that the pulse width of the light reception pulse signal is increased. As a result, even if the pulse number of the light reception pulse signal is decreased, the pulse width is increased in correspondence with the decrease. By offsetting the increase and the decrease, therefore, the total value of light reception pulse widths per unit time period is made unvaried.

For example, the smoke density detecting section which detects a smoke density based on a total pulse width of the pulse width per unit time period comprises: a comparing section in which a predetermined threshold value for the light reception pulse signal supplied from the light receiving section is set, and which shapes a waveform of the light reception pulse signal to form a rectangular signal having a width equal to a pulse width of a light reception pulse signal which exceeds the threshold value; an integrating section which integrates a rectangular signal supplied from the comparing section for the unit time period; a holding section which extracts and holds an integrated value for the unit time period of the integrating section; and a smoke density converting section which converts the integrated value held by the holding section into a smoke density.

In another example of the invention, a smoke density detecting section-may be disposed which detects the smoke density based on an integrated value per unit time period of the light reception pulse signal supplied from the light receiving section. Also in the case where the smoke density is detected from the integrated value of the light reception pulse signal per unit time period, when the actual flow rate is increased with respect to a preset flow rate serving as a reference, the velocity of smoke particles passing through the smoke detecting space is increased, and also the pulse number of light reception pulse signal for scattered light per unit time period is increased. However, the pass time required for the smoke particles to pass through the smoke detecting area is decreased, and hence also the time period in which scattered light can be received is decreased, so that an integrated value determined by the waveform area of the light reception pulse signal is decreased. As a result, even if the pulse number of the light reception pulse signal is increased, the integrated value of light reception pulses is decreased in correspondence with the increase. By offsetting the increase and the decrease, therefore, the integrated value of light reception pulses per unit time period is made unvaried.

In contrast, when the actual flow rate is reduced with respect to the preset flow rate serving as a reference, the velocity of smoke particles passing through the smoke detecting space is decreased, and also the pulse number of the light reception pulse signal for scattered light per unit time period is decreased. However, the pass time required for the smoke particles to pass through the smoke detecting area is increased, and also the time period in which scattered light can be received is increased, so that an integrated value determined by the waveform area of the light reception pulse signal is increased. As a result, even if the pulse number of the light reception pulse signal is decreased, the integrated value of the light reception pulse signal is increased in correspondence with the decrease. By offsetting the increase and the decrease, therefore, the integrated value of light reception pulses per unit time period is made unvaried.

For example, the smoke density detecting section which detects a smoke density based on an integrated value of the light reception pulse signal comprises: a slice processing section in which a predetermined threshold value for a light reception pulse signal supplied from the light receiving section is set, and which outputs a light reception pulse signal component which exceeds the threshold value; an integrating section which integrates the light reception pulse signal sliced in the slice processing section, every the unit time period; a holding section which extracts and holds an integrated value per the unit time period obtained in the integrating section; and a smoke density converting section which converts the integrated value held by the holding section into a smoke density.

The light projecting section which is used in the smoke detecting apparatus of the invention forms a light source image of a light-emitting face of the laser diode, in the smoke detecting area by means of an imaging lens, and the light receiving device is disposed on an optical axis which is set in a predetermined direction and which passes through an imaging position of the light source image in the smoke detecting area, thereby receiving light scattered by smoke particles.

When an imaging optical system for forming a minute spot in the smoke detecting area is used, the imaging position serving as the smoke detecting area may be set to be an area of about 1 $\mu$m, so that smoke particles having a particle size in the range of about 0.3 to 1.0 $\mu$m can be accurately detected one by one.

Preferred embodiments according to the present invention will be described as follows referring to the accompanying drawings.

FIG. 1 shows the whole configuration of the smoke detecting apparatus of the invention. Referring to FIG. 1, the smoke detecting apparatus 1 is installed for detecting smoke due to a fire in a computer room, a clean room in which semiconductor manufacturing equipment is disposed, or the like, at an extremely early stage. A detecting pipe 2 disposed in a monitored zone is connected to the smoke detecting apparatus 1. For example, the detecting pipe 2 is a T-shaped pipe having a plurality of suction holes 3.

The detecting pipe 2 is connected to an inlet of a smoke detecting section 4 disposed in the smoke detecting apparatus, and an outlet side is opened in a chamber provided with a sucking device 7. In a monitoring state, the sucking device 7 is driven by a motor so as to suck air at a predetermined flow rate. Accordingly, the air which is once sucked through the suction holes of the detecting pipe 2 disposed in a security zone is discharged from the sucking device 7 through the smoke detecting section 4.

The suction flow rate of the air sucked by the sucking device 7 is determined in design, but the actual flow rate is varied with respect to the preset flow rate, due to rotation fluctuations of the motor, and the like. In accordance with the fluctuations of the suction flow rate, also the pass velocity of smoke particles contained in the air passing through the smoke detecting section 4 is varied.

The smoke detecting section 4 comprises a laser diode (LD) 5 which performs single-polarization oscillation having the electric field component in a predetermined deflection direction, and a photodiode (PD) 6 serving as a light receiving device. The photodiode 6 is, for example, a PIN photodiode.

Airborne particles (aerosol) including smoke particles existing in the sucked air which passes through the smoke detecting section 4 are detected in the following manner. Scattered light caused by laser light radiation from the laser diode 5 is detected by the photodiode 6. A light reception pulse signal corresponding to the scattered light is supplied to a signal processing section 8 to be subjected to signal processing for the smoke density detection. In the invention, unlike the prior art in which the pulse number of the light reception pulse signal per unit time period is counted and converted into a smoke density, the signal processing for detecting the smoke density based on the light reception pulse signal in the signal processing section 8 detects the smoke density on the basis of either of the following values:

(1) a total value of pulse widths of the light reception pulse signal obtained per unit time period; and (2) an integrated value of the light reception pulse signal obtained per unit time period.

Figure 2:
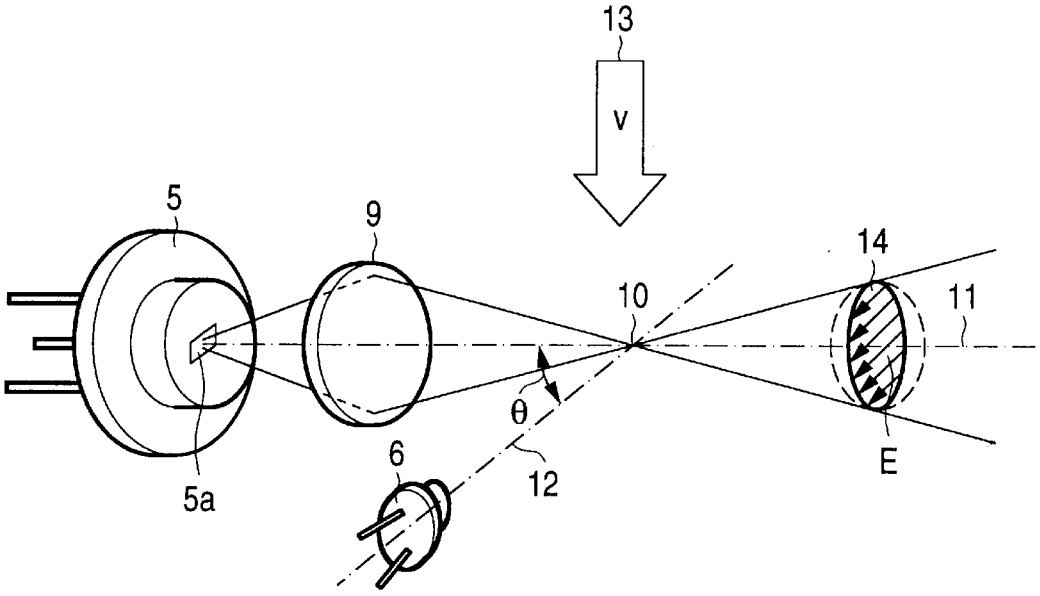
FIG. 2 is a block diagram illustrating a smoke particle detecting structure of the scattered light type according to the invention and provided with a sensitivity test function.

FIG. 2 is a diagram illustrating a smoke particle detecting structure of the scattered light type which is used in the invention and disposed in the smoke detecting section 4 shown in FIG. 1. Referring to FIG. 2, the laser diode 5 performs so-called single-polarization oscillation in which the electric field of the emitted laser light is determined in a predetermined direction, and incorporates a laser diode chip 5*a*. The laser light emitted from the laser diode 5 spreads as a diffusion wave as propagating in the direction of a projection optical axis 11.

Subsequent to the laser diode 5, an imaging lens 9 is disposed. The imaging lens 9 converges the laser light from the laser diode 5 to form a light source image of the laser diode 5, i.e., a light source image (far field pattern) of a light-emitting face of the laser diode chip 5*a*, at an imaging position 10 through which an air flow 13 to undergo the smoke detection passes, thereby forming a minute spot area of about 1 $\mu$m.

At the imaging position 10 of the light source image of the laser diode 5 which is formed by the imaging lens 9, the photodiode 6 is disposed so as to have a reception optical axis 12 which is set to elongate in, for example, a direction perpendicular to the projection optical axis 11, i.e., in a direction of $\theta=90°$. The photodiode 6 is disposed in, for example, a direction parallel to a direction of the electric field E indicated by arrows in an oval pattern (far field pattern) 14 which shows the light intensity distribution in an optical axis sectional direction of laser light which diffuses beyond the imaging position 10.

According to the experiments by the inventor of the invention, when the photodiode 6 serving as a light receiving device is disposed in the direction parallel to the direction of the electric field E in this way, the scattered light caused by the smoke particles which pass through the minute spot of the imaging position 10 can be received with the highest efficiency.

Figure 3:
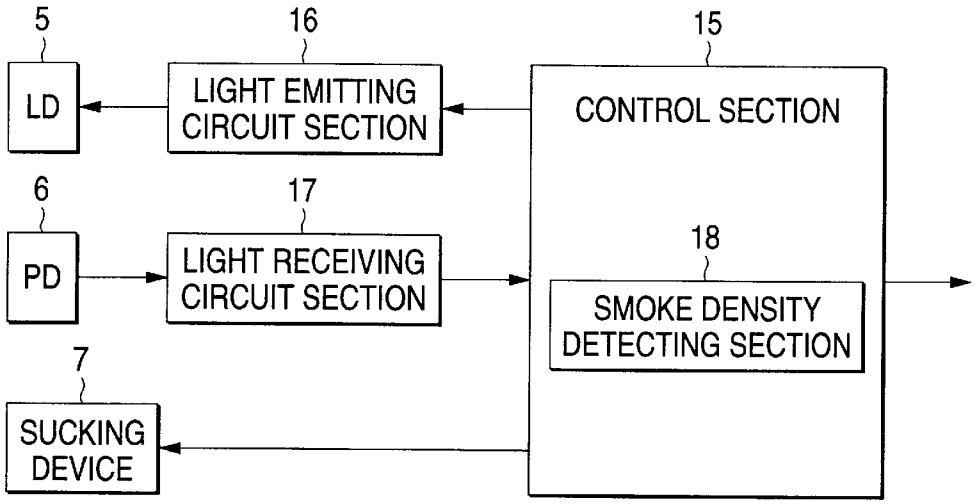
FIG. 3 is a block diagram of a signal processing device shown in FIG. 1.

FIG. 3 is a block diagram of the signal processing section 8 shown in FIG. 1. The signal processing section comprises a control section 15. The laser diode 5 is connected to the control section 15 via a light emitting circuit section 16. The output of the photodiode 6 is coupled to an input of the control section 15 via a light receiving circuit section 17. In addition, the sucking device 7 comprising the motor is connected the control section. A smoke density detecting section 18 is disposed in the control section 15.

Figure 4:
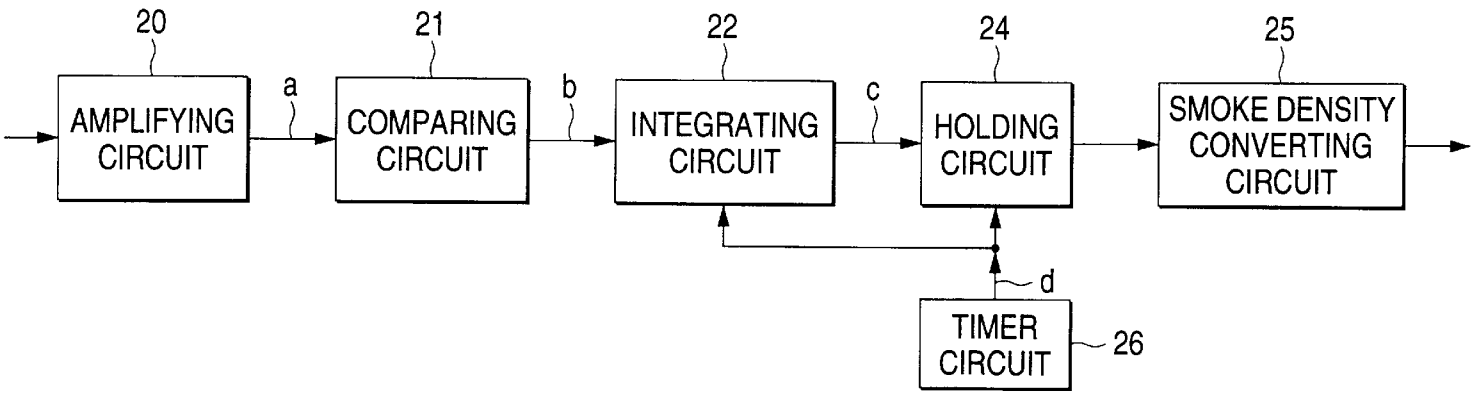
FIG. 4 is a circuit block diagram of a smoke density detecting section of FIG. 3 which detects the smoke density based on a total pulse width per unit time period.

FIG. 4 shows a circuit block of the smoke density detecting section 18 disposed in the control section 15 of FIG. 3. The circuit block includes the light receiving circuit section 17. In an embodiment of the circuit block of the smoke density detecting section 18 of FIG. 4, the smoke density is detected based on a total value of pulse widths of the light reception pulse signal for scattered light which are obtained per unit time period T.

For this purpose, the smoke density detecting section 18 comprises an amplifying circuit 20, a comparing circuit 21, an integrating circuit 22, a holding circuit 24, a smoke density converting circuit 25, and a timer circuit 26. The amplifying circuit 20 receives the light reception pulse signal which is produced from laser light scattered by smoke particles passing through the imaging position 10 and received by the light receiving device 6 shown in FIG. 2. Since the light reception pulse signal is weak in level, the signal is amplified at a predetermined amplification factor. Thereafter, the amplified signal is output to the comparing circuit as a light reception pulse signal a.

Figure 5:
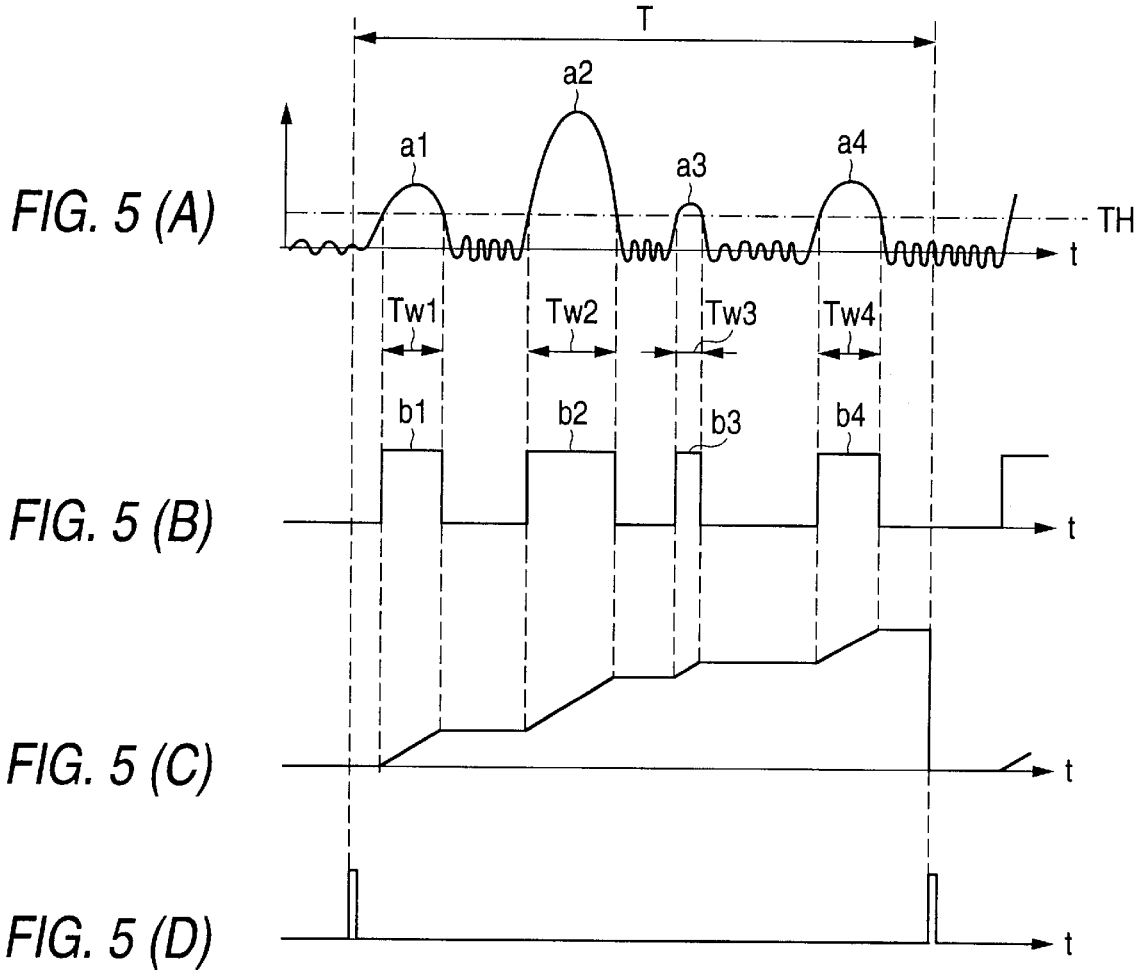
FIGS. 5(A) to 5(D) are timing charts showing the operation of the smoke density detecting section of FIG. 3, FIG. 5(A) showing a light reception signal a, FIG. 5(B) showing a rectangular shaped signal b, FIG. 5(C) showing an integration signal c, FIG. 5(D) showing a reset signal d.

FIG. 5(A) shows the light reception signal a output from the amplifying circuit 20. Every time when a smoke particle passes through the imaging position 10 for the laser light and serving as the smoke detecting area, a light reception pulse signals a1, a2, a3, a4, . . . caused by the scattered light is obtained. In each of the light reception pulse signals a1 to a4, the height of the signal is directly proportional to the size of the corresponding smoke particle, and the pulse width is directly proportional to the time period required for the smoke particle to pass through the smoke detecting spot area in which an image of the laser light is formed.

The velocity of a smoke particle which passes through the smoke detecting area is directly proportional to the flow rate of the suction produced by the sucking device 7. Accordingly, when the suction flow rate is increased as compared with the preset flow rate, also the velocity of a smoke particle passing through the smoke detecting area is increased. As a result, the pulse width of the light reception pulse signal is decreased. Conversely, when the suction air flow is decreased, also the velocity of a smoke particle passing through the smoke detecting area is decreased. In this case, the pulse width of the light reception pulse signal is increased.

Subsequent to the amplifying circuit 20 shown in FIG. 4, the comparing circuit 21 is disposed. In the comparing circuit 21, in order to detect the pulse widths of the pulse signals a1 to a4 which vary in an analog manner as shown in FIG. 5(A), a threshold value TH is set to a predetermined value which exceeds a noise level. The comparing circuit 21 outputs a rectangular shaped signal b shown in FIG. 5(B) having light reception pulses a1 to a4 of a width which exceeds the threshold value TH. The rectangular shape signal b is a pulse-width conversion signal obtained as a result of comparison of the light reception signals a1 to a4 with the threshold value TH.

Subsequent to the comparing circuit 21 shown in FIG. 4, the integrating circuit 22 is disposed. The integrating circuit 22 integrates the rectangular shaped signal b corresponding to the pulse widths of the light reception pulse signals a1 to a4 shown in FIG. 5(B), so as to output an integration sum signal c such as shown in FIG. 5(C). The integration signal c is obtained from an integrated sum value of four rectangular shaped signals b1 to b4 over the unit time period T. If the pulse widths of the four rectangular shaped signals b1 to b4 are respectively indicated by Tw1, Tw2, Tw3, and Tw4, the integration sum value has a level which is proportional to the total pulse width Tw calculated by the following expression:

$$Tw=Tw1+Tw2+Tw3+Tw4.$$

The holding circuit 24 which is disposed subsequent to the integrating circuit 22 takes and holds the integration signal c from the integrating circuit 22 at the rising timing of a reset signal d which is output from the timer circuit 26 at periods of the unit time period T as shown in FIG. 5(D). The reset signal d from the timer circuit 26 is supplied also to the integrating circuit 22, so that the reset and start of the integrating circuit 22 are performed at periods of the unit time period T.

The smoke density converting circuit 25 converts the total pulse-width value of the light reception pulse signal for the unit time period T which value is held in the holding circuit 24, into a smoke density. A conversion table for converting the total pulse-width value into a smoke density can be prepared as a theoretical value by determining parameters such as the size of a smoke particle, the pass velocity through the smoke detecting section, the level of the light reception pulse signal for the smoke particle, the threshold value TH for waveform shaping, and the like.

Next, the operation of the embodiment realized by the circuit block shown in FIG. 4 will be described. Every time when a smoke particle passes through the smoke detecting area serving as a beam spot of the imaging area which is obtained by confining the laser beam, the light reception pulse signal having a peak level which is proportional to the size of the smoke particle is input into the amplifying circuit 20 as shown in FIG. 5(A). After an amplification by the amplifying circuit 20, the light reception pulse signals a1, a2, a3, a4, . . . shown in FIG. 5(A) are output. The light reception pulse signal a from the amplifying circuit 20 is input into the comparing circuit 21 to be compared with the preset threshold value TH.

For example, the light reception pulse signal a1 is waveform-shaped into a rectangular signal such as the rectangular shaped signal b1 in FIG. 5(B) which is at an L level in a period when the light reception pulse signal a1 is lower than the threshold value TH, rises to an H level when the light reception pulse signal exceeds the threshold value TH, and falls to the L level when the peak level is over and the light reception pulse signal becomes again lower than the threshold value TH. As a result, the light reception pulse signal a1 is converted into the rectangular shaped signal b1 having a pulse width Tw1 which is obtained by cutting the pulse waveform at the threshold value TH.

Similarly, the light reception pulse signals a2, a3, and a4 are converted into the rectangular shaped signals b2, b3, and b4 having pulse widths Tw2, Tw3, and Tw4 which are as viewed from the threshold value TH, respectively. In the case of FIGS. 5(A) to 5(D), the four light reception pulse signals a1 to a4 are obtained in the unit time period T. Accordingly, the integrating circuit 22 which is reset and started by the reset signal d from the timer circuit 26 performs an accumulation and integrating operation in which a capacitor is charged over H level periods of the rectangular shaped signals b1 to b4, as in the integration signal c of FIG. 5(C).

At the rising timing when the reset signal d is obtained after the unit time period T elapses, therefore, the integration sum signal c has a value which is proportional to the total pulse width Tw of the pulse widths Tw1 to Tw4 of the four rectangular shaped signals b1 to b4. The value is held in the holding circuit 24, and then output to the smoke density converting circuit 25 over the next unit time period T, thereby performing the conversion to a smoke density corresponding to a final integration sum value.

If the flow rate of the air sucked by the sucking device 7 is increased as compared with the condition of FIGS. 5(A) to 5(D), the velocity of smoke particles passing through the smoke detecting area is increased, and the pulse number of the light reception pulse signal a obtained in the unit time period T is increased. For example, for equal smoke densities, when the flow rate is doubled, the pulse number of the light reception pulse signal obtained in the unit time period T is also doubled from four in the case of FIG. 5(A) to eight.

Accordingly, the rectangular shaped signal b obtained by the comparison processing with the threshold value TH is halved from the pulse widths Tw1 to Tw4 which are obtained before the flow rate is doubled. Thus, four rectangular shaped signals are added in the unit time period T. As a result, as for the integration sum signal c of FIG. 5(C), eight rectangular shaped signals exist in the period T. Although one integrating time period depending on a pulse width is short, the number of integrations is increased from four before the increase of the flow rate, to eight. Therefore, the level of the integration sum signal c which is finally obtained in the unit time period T is little varied.

Conversely, if the flow rate of the sucked air is reduced to, for example, one half that shown in FIGS. 5(A) to 5(D), also the number of smoke particles passing through the smoke detecting area is halved. The pulse number of the light reception pulse obtained in the unit time period T is decreased from four shown in FIG. 5(A) to two after the flow rate of the sucked air is halved. In accordance with the decrease of the flow rate, however, the pulse width of the light reception pulse signal is doubled. As a result, the integration result by the integration signal c is little varied.

In the embodiment of FIG. 4, the smoke density is detected based on the total value of the pulse widths of the light reception pulse signal obtained in the unit time period T. Even if the flow rate of sucked air is varied, therefore, a constant total pulse-width value is always obtained unless the smoke density is varied. Accordingly, it is possible to realize the smoke density detection with high accuracy and without being affected by fluctuations of the flow rate of the sucked air.

Figure 6:
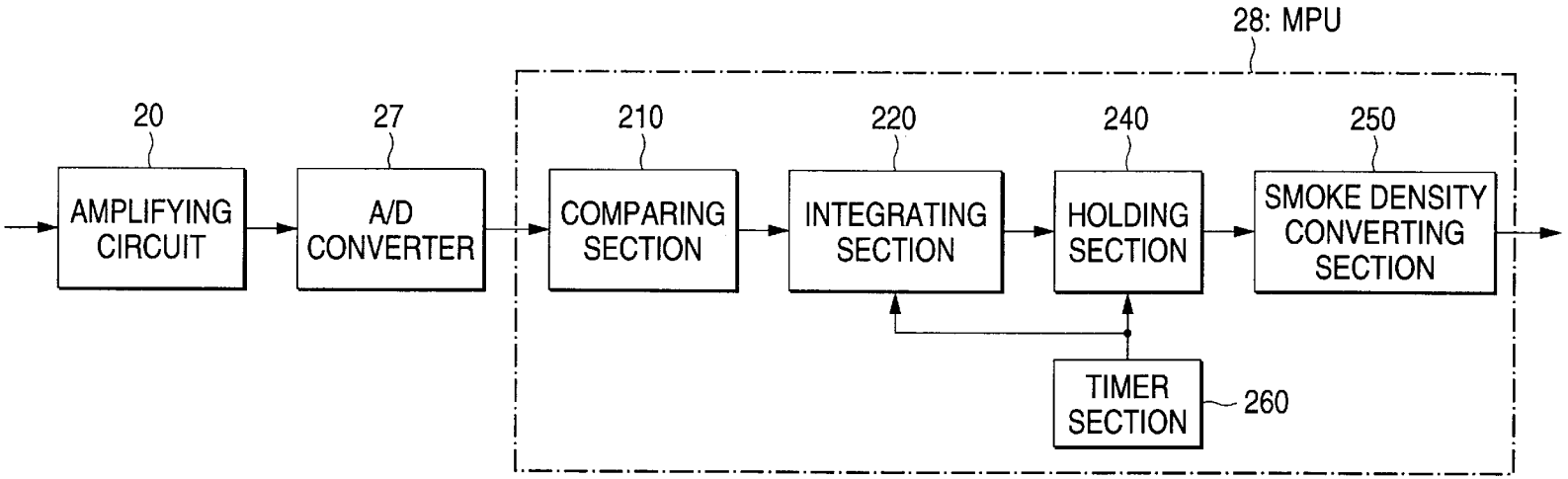
FIG. 6 is a function block diagram of the smoke density detecting section of FIG. 3 which uses an MPU for detecting the smoke density based on a total pulse width per unit time period.

In FIG. 6, part of the circuit block shown in FIG. 4 is implemented by a program control of an MPU. In FIG. 6, the amplifying circuit 20 is the same as that in the embodiment of FIG. 4. An A/D converter 27 is disposed subsequent to the amplifying circuit 20. The light reception signal a of FIG. 5(A) is converted into digital data by using a predetermined sampling clock, and the digital data is supplied to an MPU 28. The MPU 28 comprises a comparing section 210, an integrating section 220, a holding section 240, a smoke density converting section 250, and a timer section 260.

In these processing sections of the MPU 28, the hardware ranging from the comparing circuit 21 to the timer circuit 26 shown in FIG. 4 is basically realized by the program control of the MPU 28. Therefore, there is no difference in principle between the processing sections and the hardware.

Figure 7:
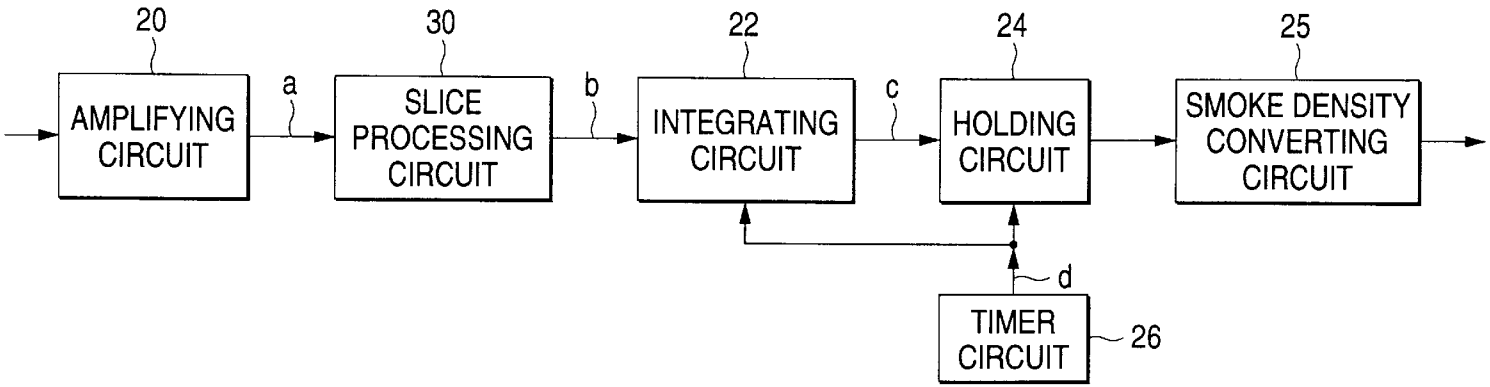
FIG. 7 is a circuit block diagram of the smoke density detecting section of FIG. 3 which detects the smoke density based on a light reception pulse integrated value per unit time period.

FIG. 7 shows another embodiment of the smoke density detecting section 18 disposed in the control section of FIG. 3. The embodiment is characterized in that an integrated value of the light reception pulse signal is obtained for each unit time period T, and the smoke density is detected based on the integrated value. The embodiment of FIG. 7 is different from that of FIG. 4 in that a slice processing circuit 30 is disposed subsequent to the amplifying circuit 20. The other components are configured in the same manner as the integrating circuit 22, the holding circuit 24, the smoke density converting circuit 25, and the timer circuit 26.

Figure 8:
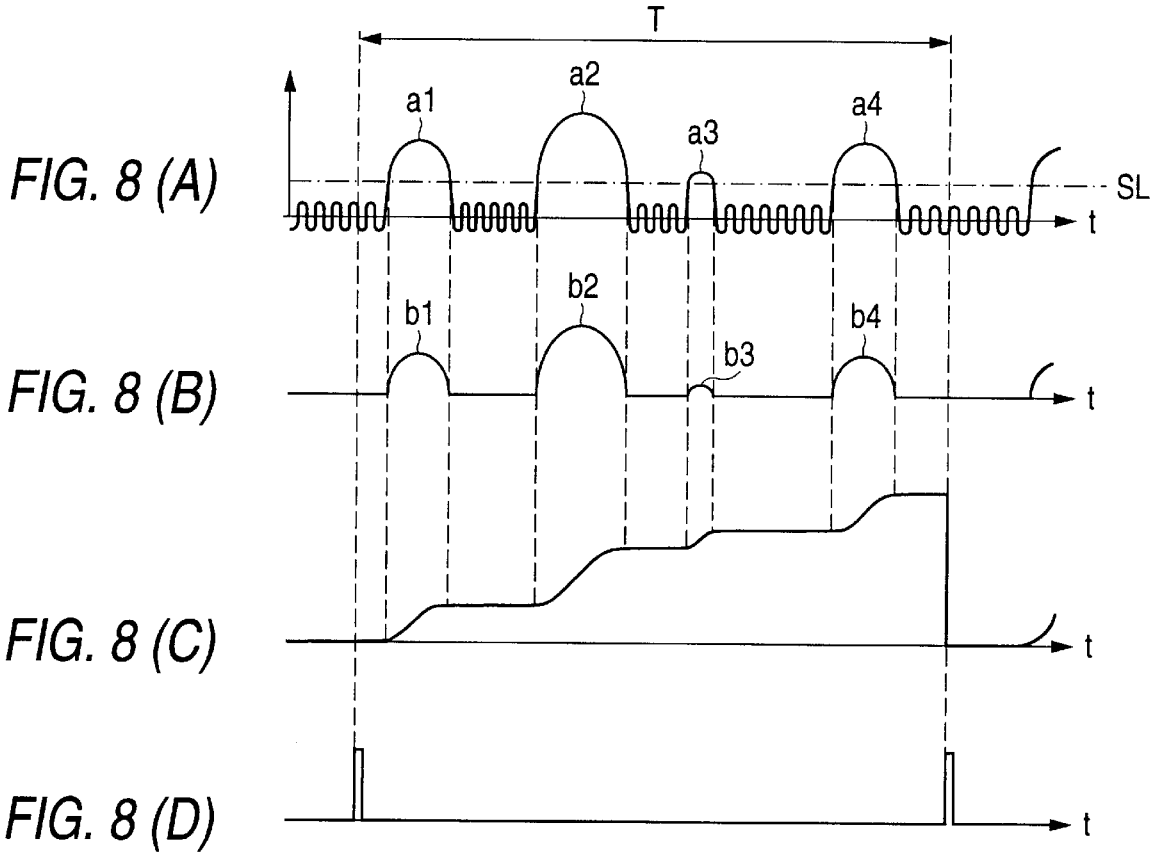
FIGS. 8(A) to 8(D) are timing charts showing the operation of the smoke density detecting section of FIG. 7, FIG. 8(A) showing a light reception signal a, FIG. 8(B) showing a sliced signal b, FIG. 8(C) showing an integeration signal c, FIG. 8(D) showing a reset signal d.

FIGS. 8(A) to 8(D) are timing charts of the embodiment of FIG. 7. The light reception pulse signal amplified in the amplifying circuit 20 is shown in FIG. 8(A) which is identical with FIG. 5(A) showing the amplified result of the light reception pulse signal in FIG. 4.

The slice processing circuit 30 extracts a signal component exceeding a slice level which is set for cutting noise components. A predetermined slice level SL for cutting noise components is set for the light reception pulse signal a of FIG. 8(A). A sliced signal b of FIG. 8(B) in which signal components lower than the slice level SL are removed away is supplied to the integrating circuit 22. The integrating circuit 22 integrates the sliced signal b for each unit time period T. In the embodiment, sliced signals b1 to b4 are obtained correspondingly to the light reception signals a1 to a4, so that the integrating circuit 22 integrates the sliced signals b1 to b4 and outputs an integration signal c of FIG. 8(C). As a result, the integration signal c from the integrating circuit 22 at the time when the unit time period T elapses has a value which is proportional to a total value of area waveform components of the four sliced signals b1 to b4 obtained in the unit time period T. The value is converted into the smoke density in the smoke density converting circuit 25.

Also in the embodiment of FIG. 7 in which the smoke density is detected by obtaining an accumulated integration of the light reception pulse signal per unit time period T, when the flow rate of the air sucked from the outside by the sucking device 7 is increased, the pulse number of the light reception pulse signal in the unit time period T is increased. When the suction flow rate is decreased, the number is decreased. Conversely, when the suction flow rate is increased, the width of the signal is decreased, and, when the suction flow rate is decreased, the width of each signal is increased.

Even if the suction flow rate is varied, accordingly, the value of the integration signal c obtained by integrating the sliced signals b and at the time when the unit time period T elapses is substantially constant unless the smoke density is varied. Thus, the smoke density can be accurately measured without being affected by fluctuations of the flow rate of the air sucked by the sucking device.

Figure 9:
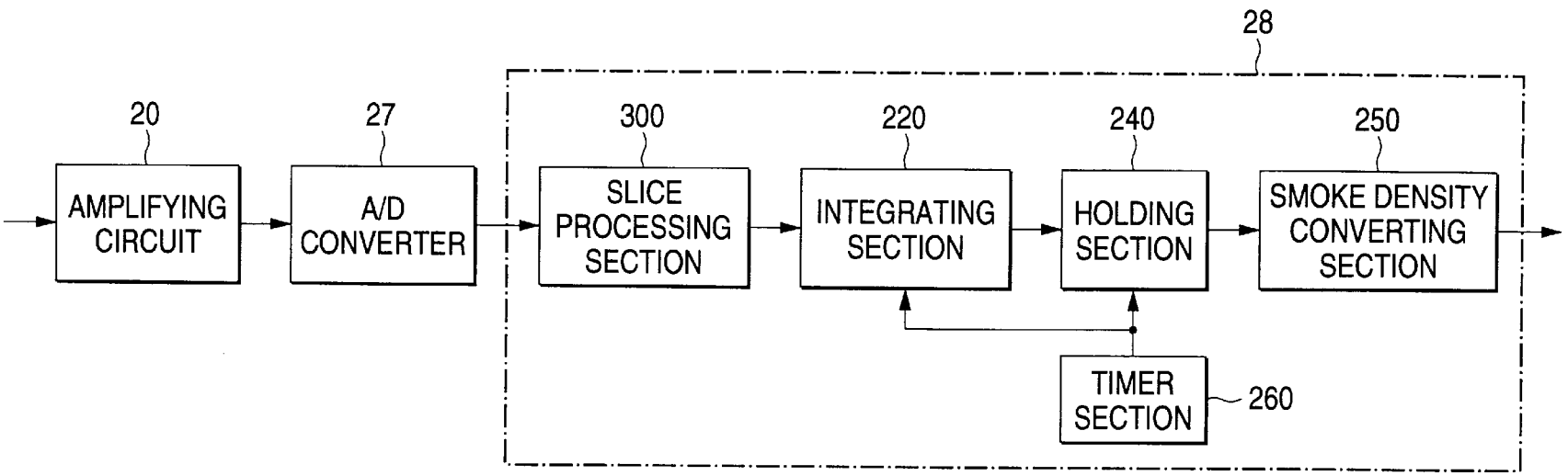
FIG. 9 is a function block diagram of the smoke density detecting-section of FIG. 3 which uses an MPU for detecting the smoke density based on a light reception pulse integrated value per unit time period.

FIG. 9 is a block diagram in which a part of the embodiment of FIG. 7 is implemented by a program control of an MPU, and corresponds to FIG. 6 showing the first embodiment. Specifically, an A/D converter 27 is disposed subsequent to the amplifying circuit 20. The light reception pulse signal of FIG. 8(A) is converted into digital data by using a predetermined sampling clock. The MPU 28 comprises a slice processing section 300, an integrating section 220, a holding section 240, a smoke density converting section 250, and a timer section 260 as functional blocks corresponding to the hardware ranging from the slice processing circuit 30 to the timer circuit 26 in FIG. 7.

Also in the embodiment in which the smoke density is obtained from an integrated value of the light reception pulse signal per unit time period T, it is possible to realize the smoke density detection with higher accuracy and without being affected by fluctuations of the flow rate of the sucked air.

In the above-described embodiments, as shown in FIG. 2, the laser light from the laser diode 5 is confined to the imaging position 10 by the imaging lens 9, so as to form a light source image of a minute beam spot. The air flow of smoke particles sucked from the outside is caused to pass through the beam spot of the imaging position. Alternatively, the invention may be applied as it is to a smoke detecting apparatus provided with a parallel-light optical system. In the parallel-light optical system, a collimator lens is used instead of the imaging lens 9, the laser light from the laser diode 5 is converted into parallel light, and the photodiode 6 serving as a light receiving device is disposed so as to form a predetermined configuration angle θ with respect to the parallel light.

What is claimed is:

1. A smoke detecting apparatus which determines a fire by optically detecting smoke particles suspended in air drawn from a monitored zone, comprising:

a light projecting section which projects laser light emitted from a laser diode to a smoke detecting area through which the air passes;

a light receiving section in which light scattered by the smoke particles passing through said smoke detecting area is received by a light receiving device, and which outputs light reception pulse signals; and a smoke density detecting section which detects pulse widths of corresponding said light reception pulse signals and detects the smoke density based on a total pulse width of said pulse widths per unit time period.

2. A smoke detecting apparatus according to claim 1, wherein said smoke density detecting section comprises:

a comparing section which sets a predetermined threshold value for said light reception pulse signal supplied from said light receiving section, and shapes a waveform of said light reception pulse signal to form a rectangular signal having a width equal to a pulse width of a light reception pulse signal which exceeds said threshold value;

an integrating section which integrates a rectangular signal supplied from said comparing section for the unit time period;

a holding section which extracts and holds an integrated value for the unit time period of said integrating section; and a smoke density converting section which converts said integrated value held by said holding section into a smoke density.

3. A smoke detecting apparatus according to claim 2 wherein said light projecting section forms a light source image of a light-emitting face of said laser diode, in said smoke detecting area by means of an imaging lens, and in said light receiving section, said light receiving device is disposed on an optical axis which is set in a predetermined direction and which passes through an imaging position of said light source image in said smoke detecting area, thereby receiving light scattered by smoke particles.

4. A smoke detecting apparatus according to claim 1, wherein the smoke density detecting section detects the smoke density based on an integrated value of the light reception pulse signal supplied from said light receiving section, every a unit time period.

5. A smoke detecting apparatus according to claim 4, wherein said smoke density detecting section comprises:

a slice processing section in which a predetermined threshold value for a light reception pulse signal supplied from said light receiving section is set, and which outputs a light reception pulse signal component which exceeds said threshold value;

an integrating section which integrates said light reception pulse signal sliced in said slice processing section, every the unit time period;

a holding section which extracts and holds an integrated value per the unit time period obtained in said integrating section; and a smoke density converting section which converts said integrated value held by said holding section into a smoke density.

6. A smoke detecting apparatus according to claim 1 wherein said light projecting section forms a light source image of a light-emitting face of said laser diode, in said smoke detecting area by means of an imaging lens, and in said light receiving section, said light receiving device is disposed on an optical axis which is set in a predetermined direction and which passes through an imaging position of said light source image in said smoke detecting area, thereby receiving light scattered by smoke particles.

7. A smoke detecting apparatus which determines a fire by optically detecting smoke particles suspended in air sucked from a monitored zone, comprising:

a light projecting section which projects laser light emitted from a laser diode to a smoke detecting area through which the sucked air passes;

a light receiving section in which light scattered by said smoke particles passing through said smoke detecting area is received by a light receiving device, and which outputs a light reception pulse signal; and a smoke density detecting section which detects a pulse width of said light reception pulse signal supplied from said light receiving section and detects the smoke density based on a total pulse width of said pulse width per a unit time period, said smoke density detecting section comprising:

a comparing section which sets a predetermined threshold value for said light reception pulse signal supplied from said light receiving section, and shapes a waveform of said light reception pulse signal to form a rectangular signal having a width equal to a pulse width of a light reception pulse signal which exceeds said threshold value;

an integrating section which integrates said rectangular signal supplied from said comparing section for said unit time period;

a holding section which extracts and holds an integrated value for said unit time period of said integrating section; and a smoke density converting section which converts said integrated value held by said holding section into a smoke density.

8. A smoke detecting apparatus which determines a fire by optically detecting smoke particles suspended in air sucked from a monitored zone, comprising:

a light projecting section which projects laser light emitted from a laser diode to a smoke detecting area through which the sucked air passes;

a light receiving section in which light scattered by said smoke particles passing through said smoke detecting area is received by a light receiving device, and which outputs a light reception pulse signal; and a smoke density detecting section which detects a smoke density based on the light reception pulse signal from the light receiving section, the smoke density being detected based on an integrated value of the light reception pulse signal supplied from said light receiving section, per a unit time period, wherein said smoke density detection section further comprises:

a slice processing section in which a predetermined threshold value for a light reception pulse signal supplied from said light receiving section is set, and which outputs a light reception pulse signal component which exceeds said threshold value;

an integrating section which integrates said light reception pulse signal sliced in said slice processing section, every said unit time period;

a holding section which extracts and holds an integrated value per said unit time period obtained in said integrating section; and a smoke density converting section which converts said integrated value held by said holding section into a smoke density.

9. A smoke detecting apparatus which determines a fire by optically detecting smoke particles suspended in air sucked from a monitored zone, comprising:

a light projecting section which projects laser light emitted from a laser diode to a smoke detecting area through which the sucked air passes;

wherein said light projecting section forms a light source image of a light-emitting face of said laser diode, in said smoke detecting area by means of an imaging lens;

a light receiving section in which light scattered by said smoke particles passing through said smoke detecting area is received by a light receiving device, and which outputs a light reception pulse signal;

said light receiving device being disposed on an optical axis set in a predetermined direction and which passes through an imaging position of said light source image in said smoke detecting area, thereby receiving light scattered by smoke particles; and a smoke density detecting section which detects a pulse width of said light reception pulse signal supplied from said light receiving section and detects the smoke density based on a total pulse width of said pulse width per a unit time period, said smoke density detecting section including:

a comparing section which sets a predetermined threshold value for said light reception pulse signal supplied from said light receiving section, and shapes a waveform of said light reception pulse signal to form a rectangular signal having a width equal to a pulse width of a light reception pulse signal which exceeds said threshold value;

an integrating section which integrates said rectangular signal supplied from said comparing section for said unit time period;

a holding section which extracts and holds an integrated value for said unit time period of said integrating section; and a smoke density converting section which converts said integrated value held by said holding section into a smoke density.

* * * * *